US007004347B1

(12) United States Patent
Walsh

(10) Patent No.: US 7,004,347 B1
(45) Date of Patent: Feb. 28, 2006

(54) DECORATIVE METAL CONTAINERS

(75) Inventor: Jenna Walsh, Springfield, IL (US)

(73) Assignee: Design Ideas, Ltd., Springfield, IL (US)

( * ) Notice: Subject to any disclaimer, the term of this patent is extended or adjusted under 35 U.S.C. 154(b) by 168 days.

(21) Appl. No.: 10/698,876

(22) Filed: Oct. 30, 2003

Related U.S. Application Data

(62) Division of application No. 10/160,795, filed on May 31, 2002, now abandoned, which is a division of application No. 09/634,605, filed on Aug. 5, 2000, now Pat. No. 6,398,058.

(51) Int. Cl.
*B65D 6/08* (2006.01)

(52) U.S. Cl. ..... 220/485

(58) Field of Classification Search ..... D9/661–664; D7/518, 521, 576, 582; 220/494, 489, 485, 220/668, 574
See application file for complete search history.

(56) References Cited

U.S. PATENT DOCUMENTS

| | | | |
|---|---|---|---|
| 1,683,554 | A | 9/1928 | Kenyon |
| 1,788,724 | A | 1/1931 | Libera |
| 2,116,810 | A | 5/1938 | Warner |
| D121,405 | S | 7/1940 | Watral |
| 2,317,044 | A | 4/1943 | Faulkner |
| 2,554,232 | A | 5/1951 | Young, Jr. |
| D163,630 | S | 6/1951 | Pollock |
| D176,575 | S | 1/1956 | Klingberg |
| 2,856,093 | A | 10/1958 | Bruce |
| 3,272,377 | A | 9/1966 | Schray |
| 3,672,408 | A | 6/1972 | Dubrfuil et al. |
| 5,377,617 | A | 1/1995 | Harwich |
| D369,870 | S | 5/1996 | Chang |
| D410,619 | S | 6/1999 | Hamowy |
| D420,513 | S | 2/2000 | Chen |
| 6,393,668 | B1 | 5/2002 | Olson et al. |
| 6,398,058 | B1 | 6/2002 | Walsh |

FOREIGN PATENT DOCUMENTS

| | | |
|---|---|---|
| GB | 1423121 | 1/1976 |

OTHER PUBLICATIONS

Design Ideas Catalog, "Critter Clips", item # 310129, page Office Organization #11, issued Mar. 1999.

*Primary Examiner*—Stephen Castellano
(74) *Attorney, Agent, or Firm*—SAIDMAN DesignLaw Group

(57) ABSTRACT

Containers made of metal wires of different gauges including upper and lower support wires connected by a sidewall, the sidewall being made up of a plurality of wires bent to form delicate, recognizable, decorative items. The items and support wires are connected such that a plurality of mutually supporting triangular frames are formed to brace, rigidify, and stabilize the shape of the wire container.

17 Claims, 12 Drawing Sheets

DECORATIVE METAL CONTAINERS

CROSS-REFERENCE TO RELATED APPLICATIONS

This application is a divisional of my application Ser. No. 10/160,795, filed May 31, 2002, now abandoned, which is a divisional of prior application Ser. No. 09/634,605, filed Aug. 5, 2000, now U.S. Pat. No. 6,398,058, which are incorporated by reference herein in their entirety.

BACKGROUND OF THE INVENTION

1. Field of The Invention

This invention relates to decorative metal wire containers.

2. Description of Related Art

Wire metal containers are known in the art. Representative are U.S. Pat. No. 1,788,724 issued to Libera on Jan. 13, 1931, and U.S. Pat No. 2,554,232 issued to Young, Jr. on May 22, 1951, Des. 121,405 issued to Watral on Jul. 9, 1940, and Des. 369,870 issued to Chang on May 14, 1996.

Libera shows a wire basket on which signs are attached. Young, Jr., shows a wire tray in which upper and lower support wires are connected by wires in the form of circles and triangular legs; the circles and legs interlock when plural trays are stacked and are strictly functional. Watral shows a wire rack with a wire swan positioned within a handle which is centrally located on the rack and which is not a sidewall. Chang shows a candle-holding cup supported on a base by S-shaped wire legs; again, the legs are strictly functional.

While all of the foregoing are functional, they are massive, apparently from the necessity to provide strength and stability to their containers, which makes them relatively unappealing in looks.

None of these references, nor any known to applicant, disclose the concept of a container made of wire having simulations of a recognizable, decorative figures, also made of wire, formed as part of or attached to the sidewall of the container.

OBJECTS AND SUMMARY OF THE INVENTION

The present invention overcomes the deficiencies described above by providing a wire container having upper and lower support wires, which collectively define the shape of the container and which are separated and spaced by delicate simulations of recognizable, decorative figures or items hand-crafted of wire.

It is an object of the invention to provide metal wire containers having upper and lower support wires and having sidewalls which are either formed by simulations of well-known, decorative entities made of wire or have same attached thereto.

It is a further object of the invention to provide metal wire containers having upper and lower support wires and having sidewalls formed exclusively of simulations of well-known, decorative items made of wire.

It is a further object of the invention to provide metal wire containers in which the wire simulations of well-known entities are made of smaller gauge wires than are the support wires.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
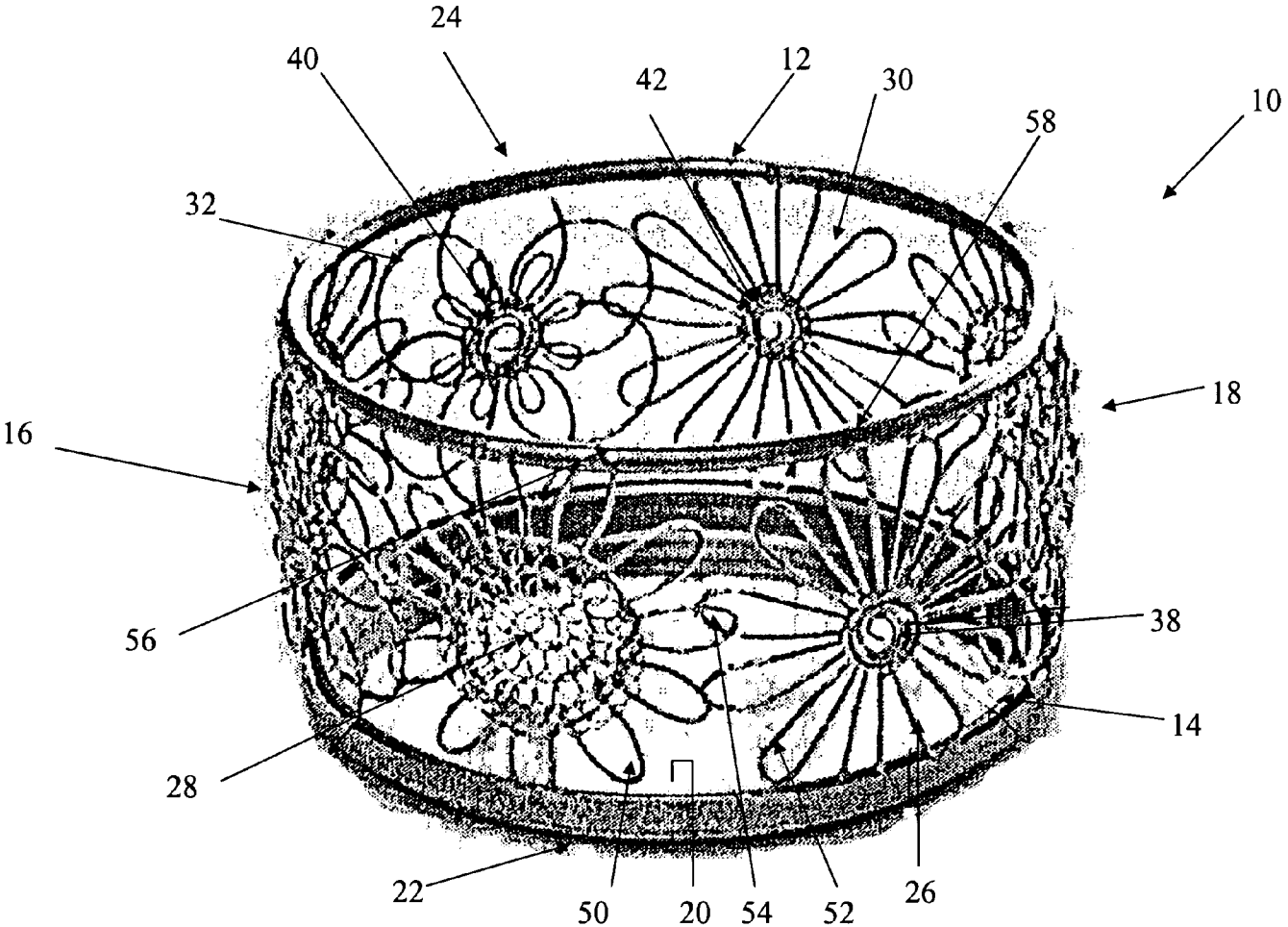
FIG. 1 is a perspective view of a storage cup for small items which illustrates the principles of the present invention.

The invention is directed to wire containers in which decorative figures either form the sidewalls of the container or are attached thereto. The principles of the invention are most easily introduced by a description of a relatively simple container. In the descriptions of the following embodiments, like reference numerals will be used to denote like parts, where applicable.

Referring to FIG. 1, a cup 10 for the reception of "doodads" (small miscellaneous items, e.g., paper clips, rubber bands, buttons, etc.) comprises an upper support wire 12, a lower support wire 14, and a sidewall 16. An impervious, metallic, lid-shaped plate 20 closes the bottom 22 of cup 10; top 24 is open. Sidewall 16 comprises a plurality of recognizable, decorative figures or items 18, shown in this embodiment as a variety of flowers 26 coupled to the upper and/or lower support wires 12 and 14 to form a chamber (i.e., an at least partially enclosed space). Flowers 26 may simulate any recognizable flower. They are illustratively disclosed as a sunflower 28, a daisy 30, and a violet 32. Sunflower 28 is most clearly shown in FIGS. 2A, 5A, and 5B, daisy 30 in FIGS. 1, 5A, 5B, and 5C, and violet 32 in FIGS. 2B, 5A, 5B, and 5C. Obviously, these decorative flowers may take any aesthetically pleasing form.

Figure 2A:
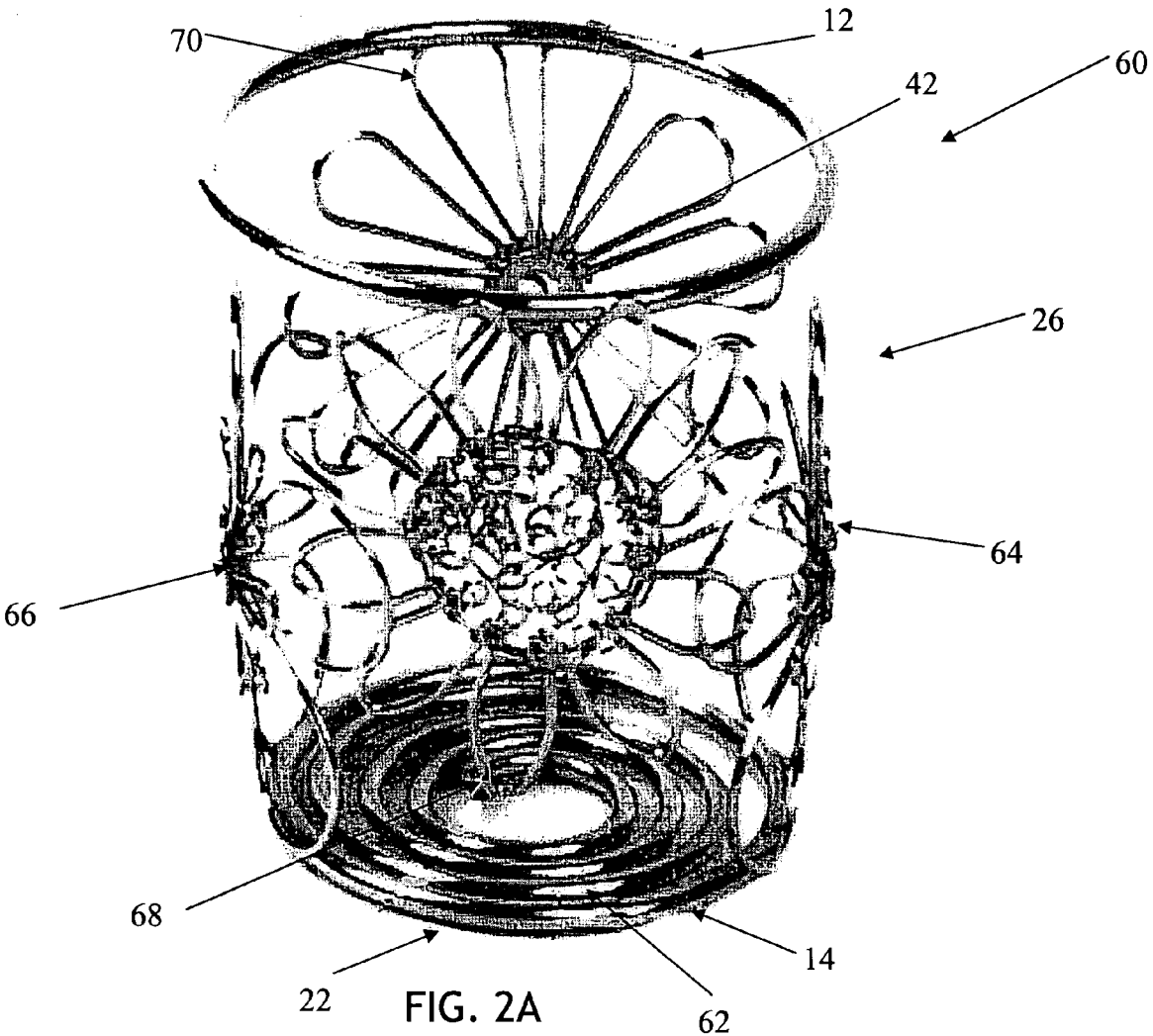
FIG. 2A is a perspective view of a votive candle cup which further illustrates the principles of the present invention.
Figure 5A:
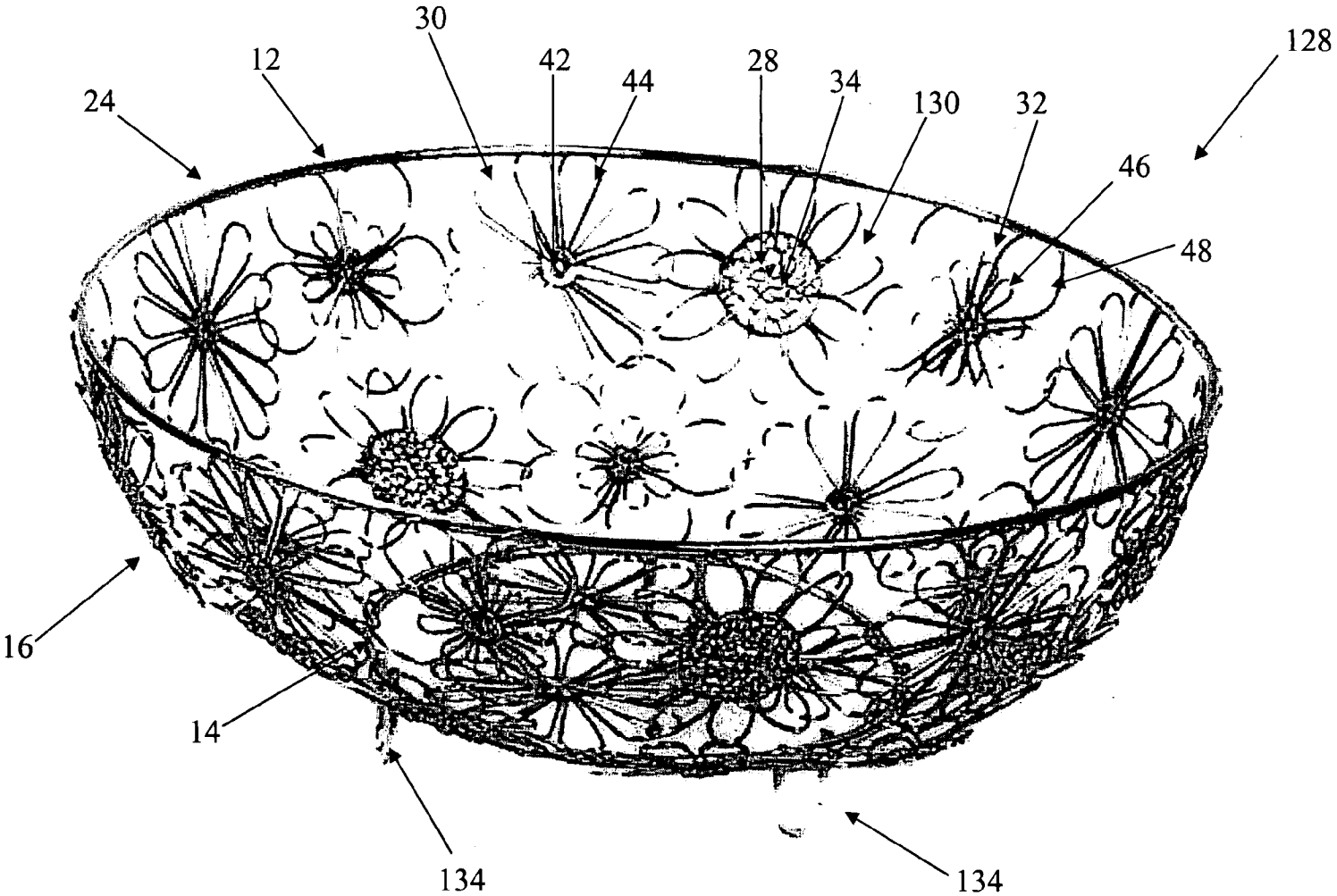
FIG. 5A is a perspective view of a fruit bowl which further illustrates the principles of the present invention.

Metal wires of differing thicknesses are preferably hand-bent and welded together to simulate the central body and surrounding petals of each flower 26. Referring to FIGS. 2A and 5A, the characteristic, large, seed-bearing central portion 34 of sunflower 28 is formed of a small gauge wire bent into small, tight loops which are helically arranged; intermediate gauge wires are bent into larger loops to simulate its petals 36. The term "loop" as used in this specification and appended claims means the portion of a figure formed by wire that curves back towards itself. The largest gauge wire is reserved for support wires, such as wires 12 and 14.

The central body 38 of daisy 30 (FIGS. 1 and 5C) is preferably formed of a helically wound, intermediate gauge wire affixed to one side of a small washer 42 (FIGS. 2A and 5A). The central body 40 of violet 32 (FIG. 2B) is likewise formed of a helically wound, intermediate gauge wire affixed to a small washer 42 (FIG. 5A).

As shown in FIG. 5A, daisies 30 show a single set of petals 44, whereas violets 32 have a pair of petal sets, a smaller, internal set 46 and a larger, surrounding set 48, all affixed, respectively, to opposite sides of their respective central washers 42.

As shown in FIG. 1, the petals of flowers 26 are selectively attached to the petals of other flowers 26, and/or to upper support wire 12 and to lower support wire 14. The preferred wire material is stainless steel, and the preferred mode of affixing them to each other is by soldering, although other materials and methods of attachment are explicitly noted as being within the scope of the invention. Stainless steel is preferred, due to its finished appearance combined with its ease of manipulation while being rigid enough to maintain its shape.

Cup 10 is constructed by forming upper support wire 12 in the shape desired for the top of the cup, in this case, a circle of an appropriate diameter, and by forming lower support wire 14 in the shape desired for the base of the cup, in this case, again a circle and, since a cylindrical shape is desired for cup 10, lower support wire 14 is of the same diameter as upper support wire 12. Lid-shaped plate 20 is soldered to lower support wire 14. Plate 20 comprises a solid surface to prevent small items from falling through it.

Figures or Items 18 are preferably pre-made by hand and are stored as inventory. For example, the types of flowers desired are selected from the inventory, aesthetically arranged, and soldered to upper support wire 12, lower support wire 14, and to its adjacent neighboring flowers 26. (While each flower 26 of cup 10 is shown as attached to its neighboring flower, other small cups, such as a tea light cup (not shown), may also be designed in which each flower is connected only to the upper and lower support wires.)

The present invention applies to wire containers the principle of triangular frames which serve as braces. Triangular frames are noted for their strength while using a minimum of materials. Their use in the construction of bicycles is an admirable example of the principle. When applied to the disclosed wire containers, each item 18 can be considered from a structural, functional point of view as an integral, rigid unit, much like a coin or other rigid disc. Connections are made at or near their perimeters, e.g., through the petals of each flower 26, which are attached to at least two, preferably three, and, in larger containers, four external elements, chosen from the following group: (1) the petals of other flowers 26; (2) upper support wire 12; and (3) lower support wire 14.

In FIG. 1, an exemplary triangular framework is formed by sunflower 50 being connected to daisy 52 at 54, both of which are connected to upper support wire 12 at 56 and at 58. Sunflower 50, daisy 52, and the enclosed segment of wire 12 between connections 56 and 58 form a rigid triangle. Other triangles formed by the intersection of selected items with other items and/or one or more of the support wires are readily distinguishable in the drawings. The principle of triangular bracing provides the wire containers with more structural rigidity than the delicate wires used would suggest. The result is a wire container which has a delicate, beautiful appearance combined with sufficient strength and integrity to be useful for its intended purpose.

Figure 2B:
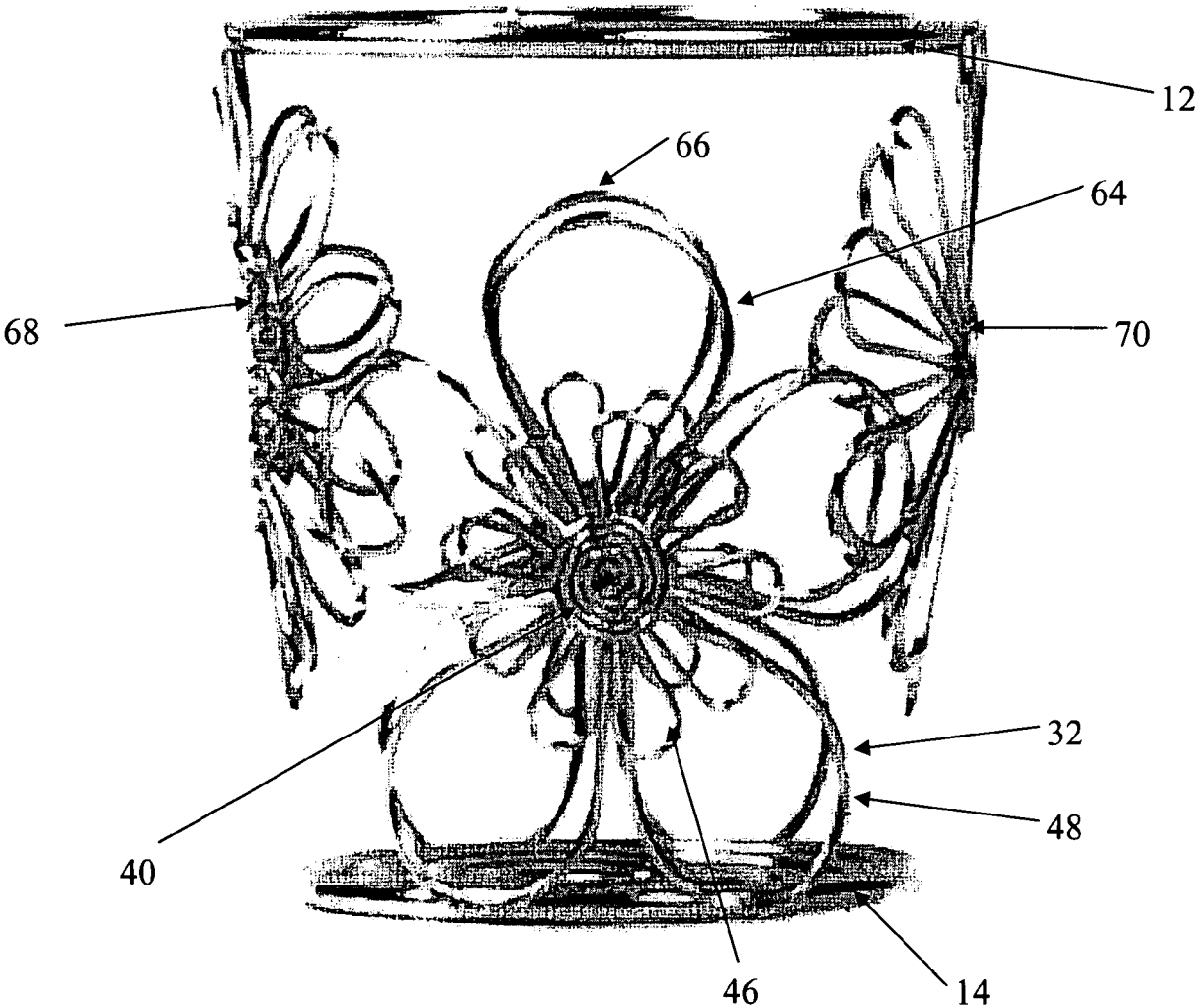
FIG. 2B is a side view of the votive cup of FIG. 2A.

In cup 10, each of the flowers 26 are connected to both upper and lower support wires 12 and 14. The votive candle cup 60 shown in FIGS. 2A–B is similar to doodad cup 10 in that each flower 26 is connected to its neighboring flower, but it differs in two ways:

(1) each flower 26 is connected to only one of the upper and lower support wires 12 and 14. For example, opposed violets 64 and 66 are not attached to upper support wire 12 (FIG. 2B); sunflower 68 and daisy 70 are not joined with lower support wire 14 (FIG. 2A); and (2) bottom 22 comprises a helical wire 62 (FIG. 2A), and, being a support wire, is of the same gauge as support wires 12 and 14. It is not necessary for the bottom 22 of votive cup 60 to be impervious. Helical wire 62 adequately supports a votive candle, and it gives a decorative touch to this embodiment of wire containers. Note the use of the triangle principle between violet 64, sunflower 68, violet 66, and lower support wire 14 in FIG. 2A and between sunflower 68, violet 64, upper support wire 12, and daisy 70 in FIG. 2B.

As in all of the embodiments within the inventive concepts disclosed herein, the upper and lower support wires define the shape of the top and bottom of the wire container. The shapes do not have to be identical, however, as was the case with cup 10. In votive candle cup 60 they are conguent but not of identical diameters. The circle defined by upper wire 12 has a larger diameter than that defined by lower wire 14. As a consequence, votive cup 60 becomes essentially a conic section as is evident from the side view shown in FIG. 2B.

Figure 3A:
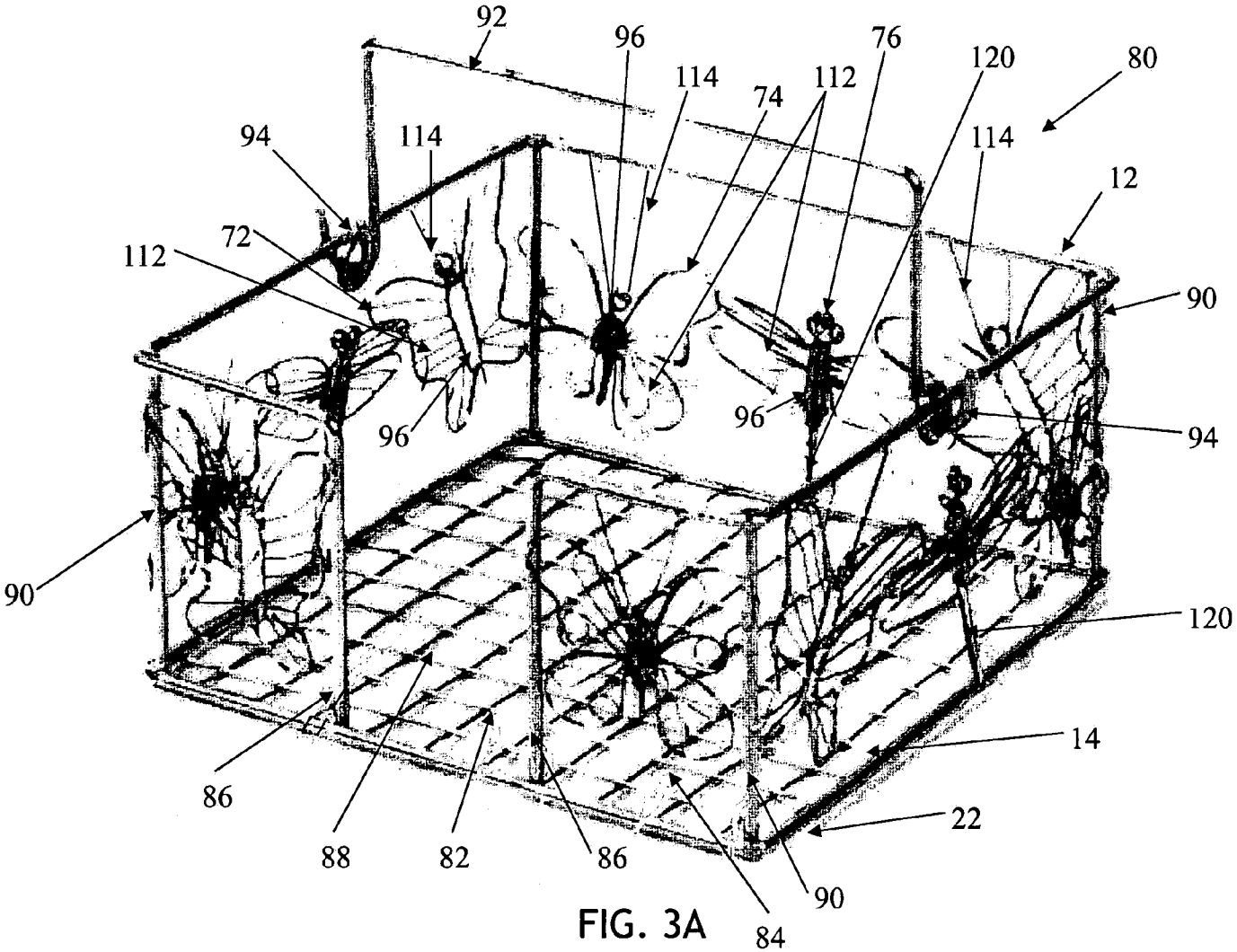
FIG. 3A is a perspective view of a napkin holder which further illustrates the principles of the present invention.
Figure 3B:
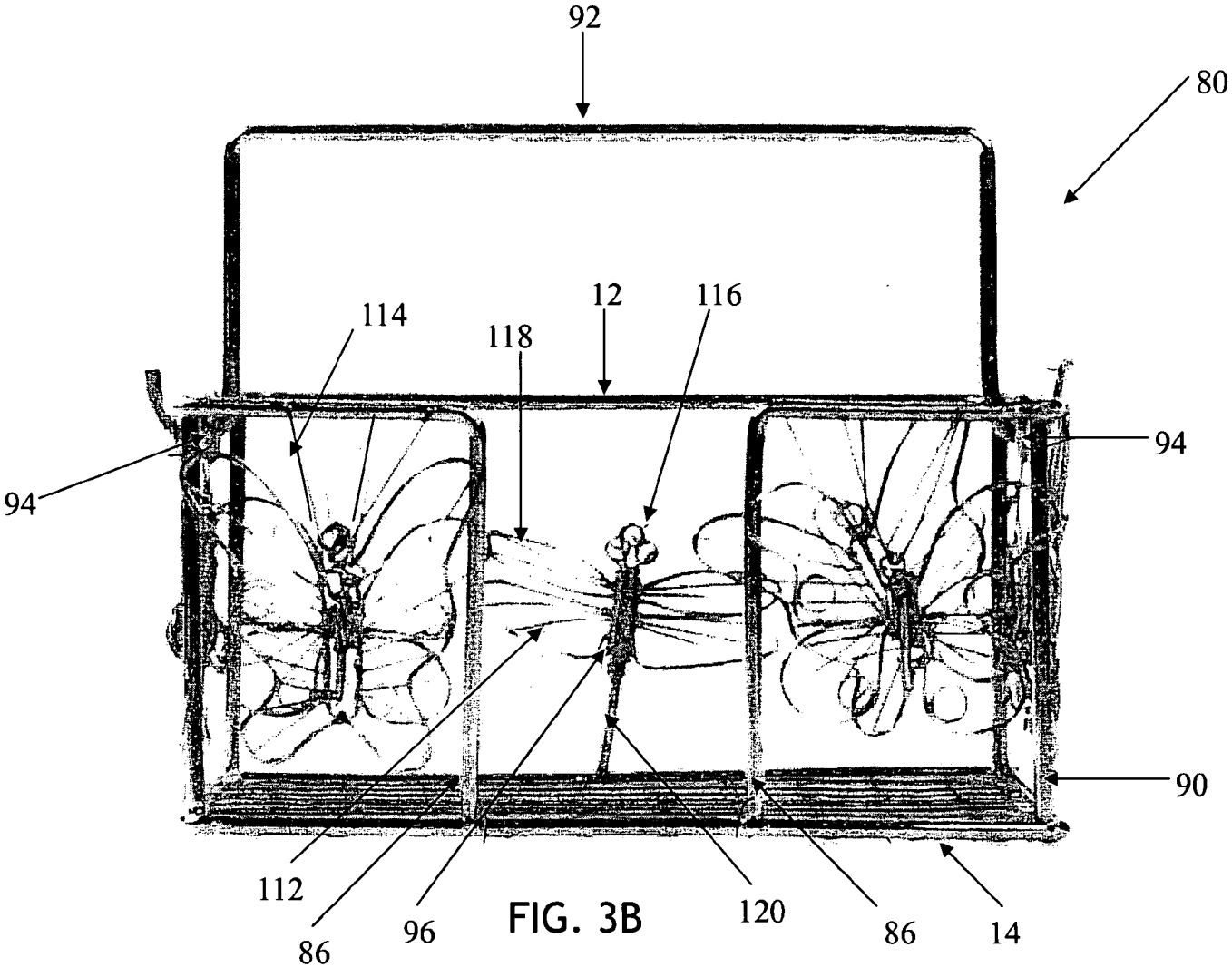
FIG. 3B is a side view of the of napkin holder of FIG. 3A.
Figure 3C:
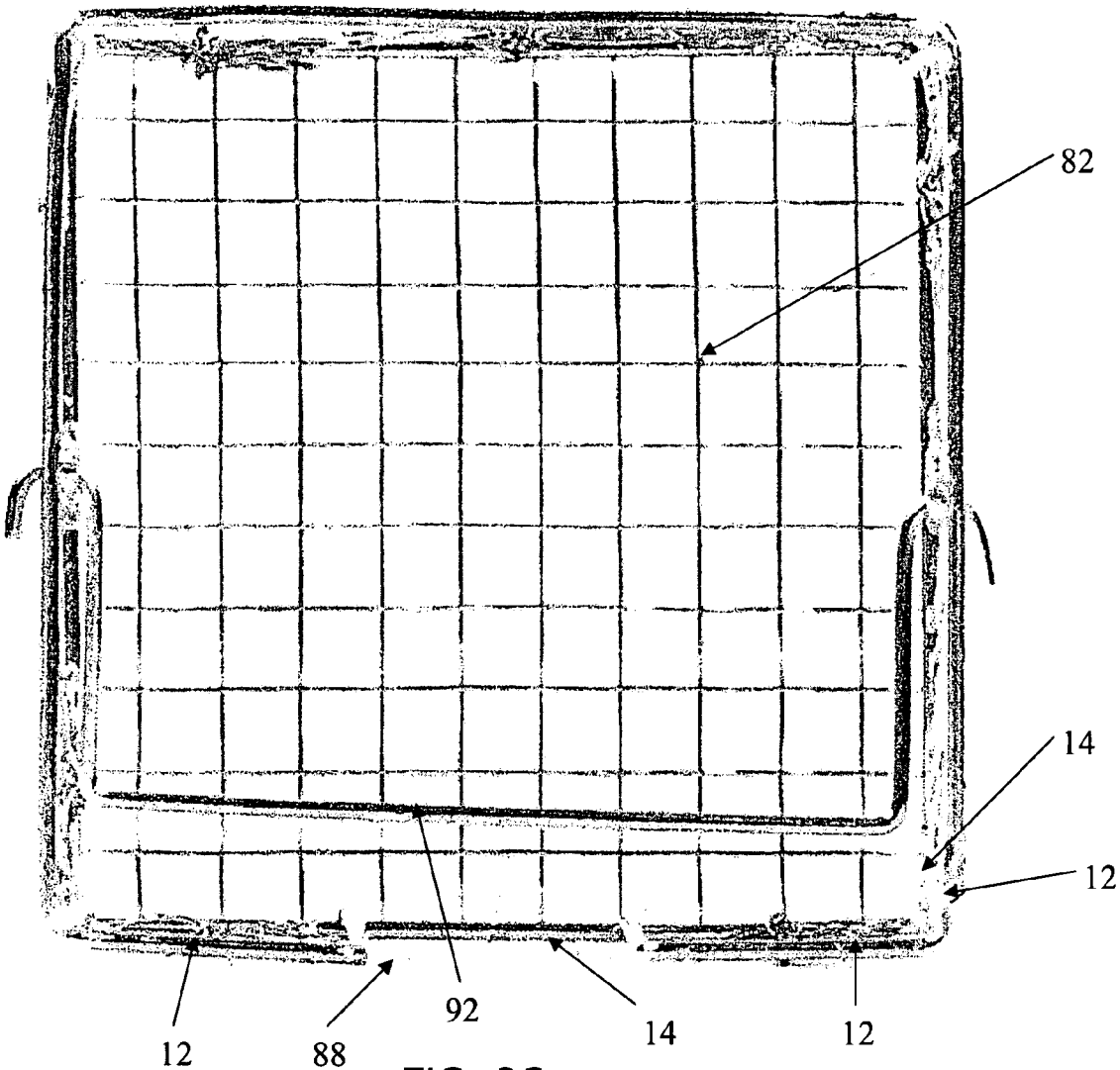
FIG. 3C is a top view of the of napkin holder of FIG. 3A.

Turning to FIGS. 3A–3C, a different form of decorative items 18 is illustrated. Three types of flying insects, e.g., two types of butterflies 72 and 74 and a dragonfly 76, collectively referred to herein as "flutters" 78, are affixed to each other and to upper and lower support wires 12 and 14 in various orientations to form a napkin holder 80. Lower support wire 14 is rectangular and is dimensioned to loosely border conventionally sized napkins. Bottom 22 comprises an open wire mesh 82 which spans lower support wire 14. Upper support wire 12 generally conforms to the shape and dimensions of lower support wire 14 except in the front sidewall 84 where the centrally located, opposed ends 86 of upper support wire 12 are bent 90° downwardly and attached to lower support wire 14.

Upper and lower support wires 12 and 14 still define the upper and lower configuration of the wire container, as in past embodiments, but they can be distinctly different from each other, as here, to provide different functions. This construction of upper wire 12 forms an opening 88 which facilitates the removal of the napkins (not shown). The four corners are provided with vertical, rigid, support wires 90 of the same gauge as upper and lower support wires 12 and 14, as much for aesthetic purposes as for reinforcement. A bail 92 is loosely constrained in wire loops 94 fixed to opposite parallel sides of upper support wire 12. Bail 92 serves double duty, as a handle for carrying napkin holder 80 (FIG. 3A) and as a restraining arm (FIG. 3C) which rests on the napkins (not shown) like a paper-weight to prevent them from becoming disheveled.

Figure 6:
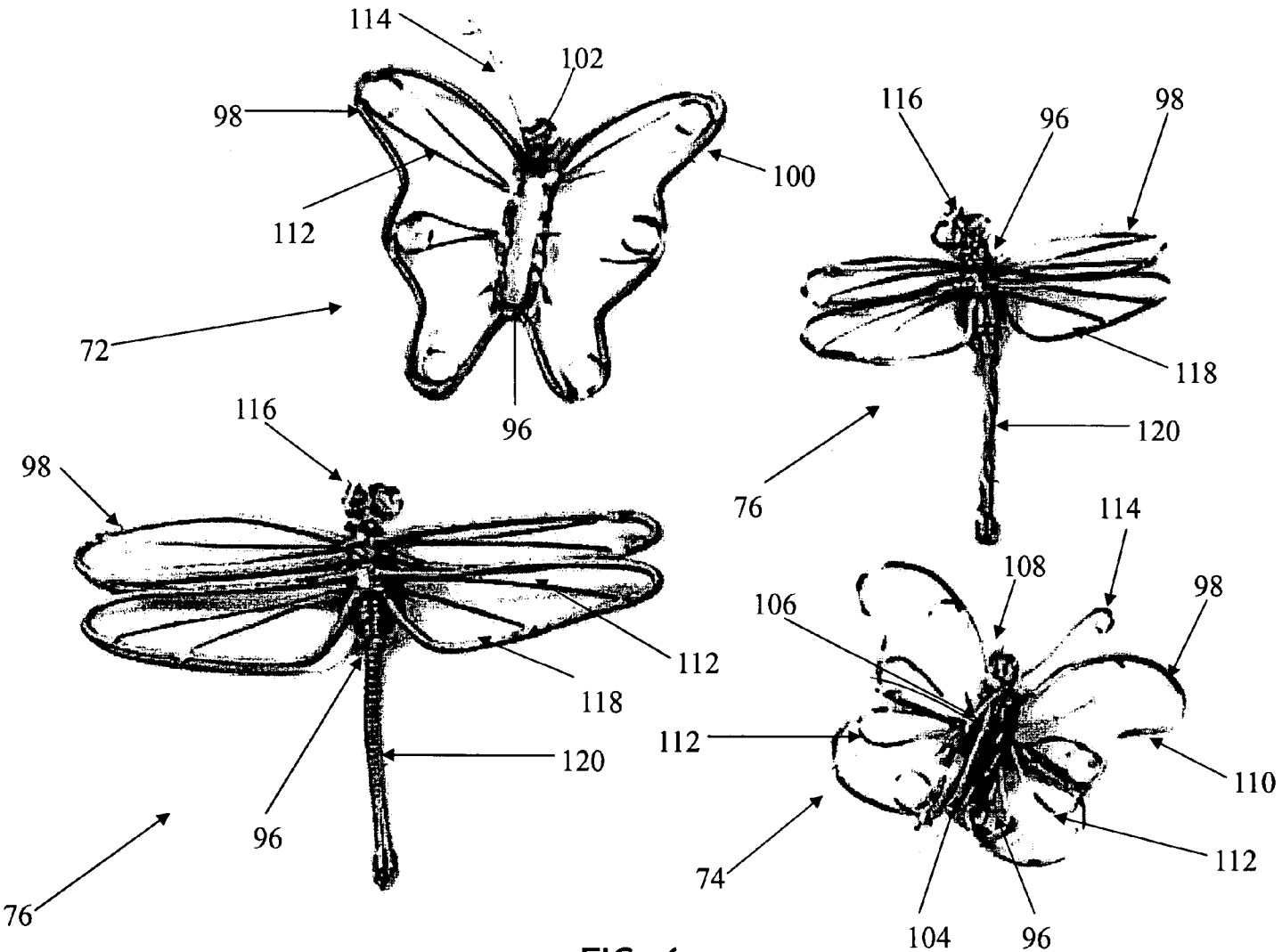
FIG. 6 is a top view of exemplary decorative figures used when practicing the invention.

Referring to FIG. 6, flutters 78 each comprise a body 96 and wings 98. Butterfly 72 has an oval wire body 96 with the wings 100 and head 102 extending outwardly therefrom. The body 96 of butterfly 74 comprises a central, longitudinal wire (not seen) with a tightly wrapped wire 104 along its length and a meandering wire 106 wrapped around a portion thereof to give bulk to the butterfly's body 96. A head 108 and wings 110 are affixed to body 96. Linear and ornately curved wires 112 simulate the delicate structures and decorative markings of butterflies 72 and 74 and dragonfly 76. A pair of single strand wires are attached to each of heads 102 and 108 to simulate antennae 114. As shown in FIG. 3A, due to their fragility, all antennae 114 are connected at their "free" ends to upper support wire 12.

Although different in the shape of its wings and body, dragonfly 76 is constructed similar to butterfly 74 with heads 116 and wings 118 fixed to tightly wrapped wire bodies 96. The triangle principle is readily evident, inasmuch as each flutter 78 is affixed to two or more other elements (i.e., other flutters, upper and lower support wires, and vertical corner wires). The shallowness of napkin holder 82 makes it convenient to affix the tails 120 of dragonflies 76 and 78 to lower support wire 14 to thereby orient them upwardly, a more pleasing presentation.

Pannier 122 (FIGS. 4A–B) is essentially a rugged basket useful for heavy duty work supporting potted plants, candles, kitchen supplies, etc., which must be moved from place to place occasionally. As usual, upper and lower support wires 12 and 14 define the oval shape of pannier 122. An open wire mesh 124 forms the bottom 22 and allows for drainage therethrough. A plurality of vertical support wires 126 symmetrically and uniformly spaced around sidewall 16 are both attractive and provide structural support to pannier 20 and its contents. A goodly mix of flutters 78 attached to each other and to the support wires makes up sidewall 16.

Unlike the previous, smaller embodiments, in which the decorative FIG. 18 were also functional as a part of the skeletal framework providing rigidity to doodad cup 10 and votive candle cup 60, napkin holder 82 and pannier 122 are adequately supported by the framework consisting of vertical support wires 90 and 126, respectively, in combination with their support wires 12 and 14. Flutters 78 are primarily decorative in this embodiment, although they do provide a certain amount of rigidity to sidewalls 16, and, of course, they prevent small articles from exiting from pannier 122 between vertical wires 90 and 126. Of course, flutters 78 can obviously be replaced with an assortment of flowers 26. The triangle principle is again evident as operative; see especially FIG. 4B.

Figure 4A:
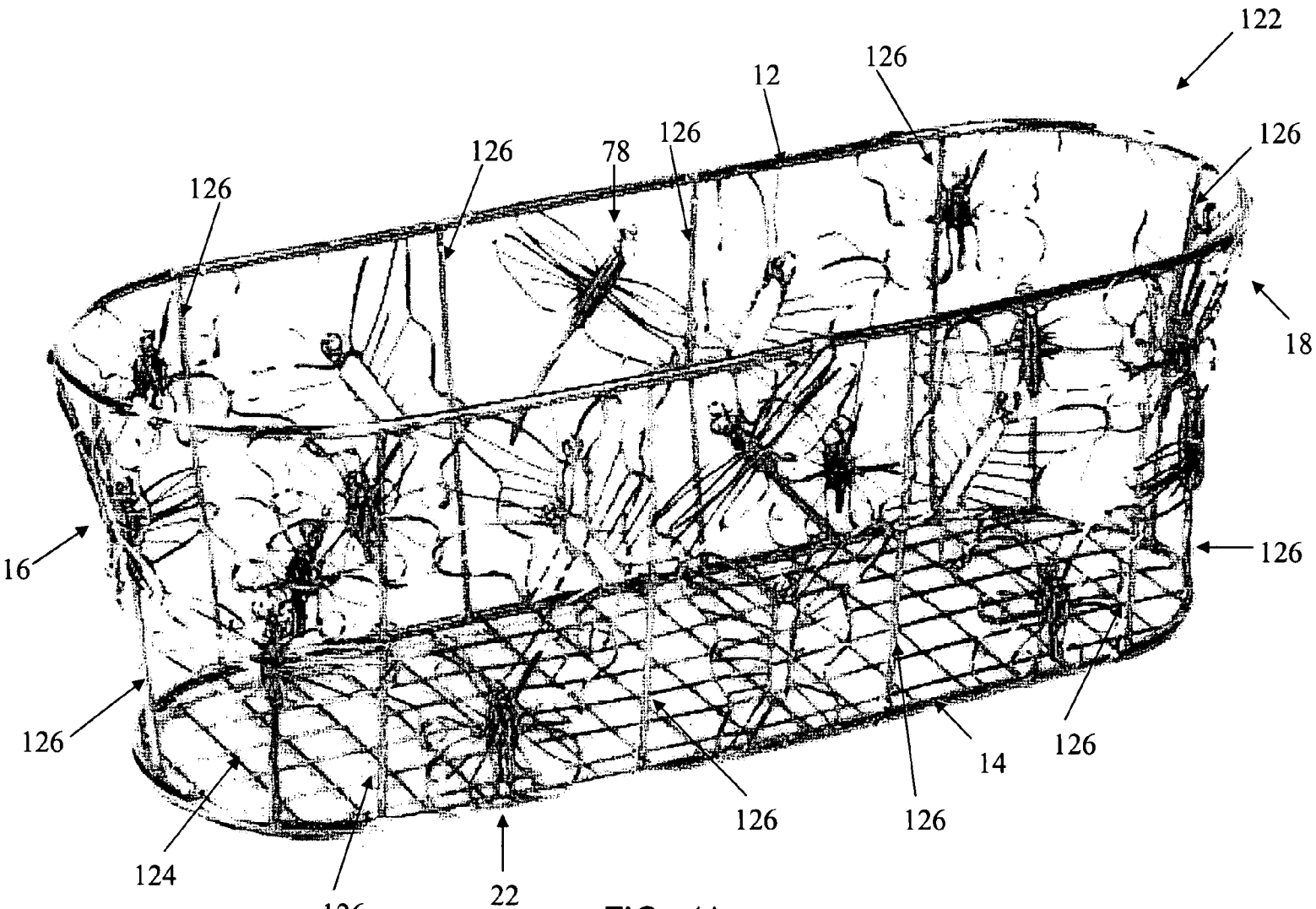
FIG. 4A is a perspective view of a pannier which further illustrates the principles of the present invention.
Figure 4B:
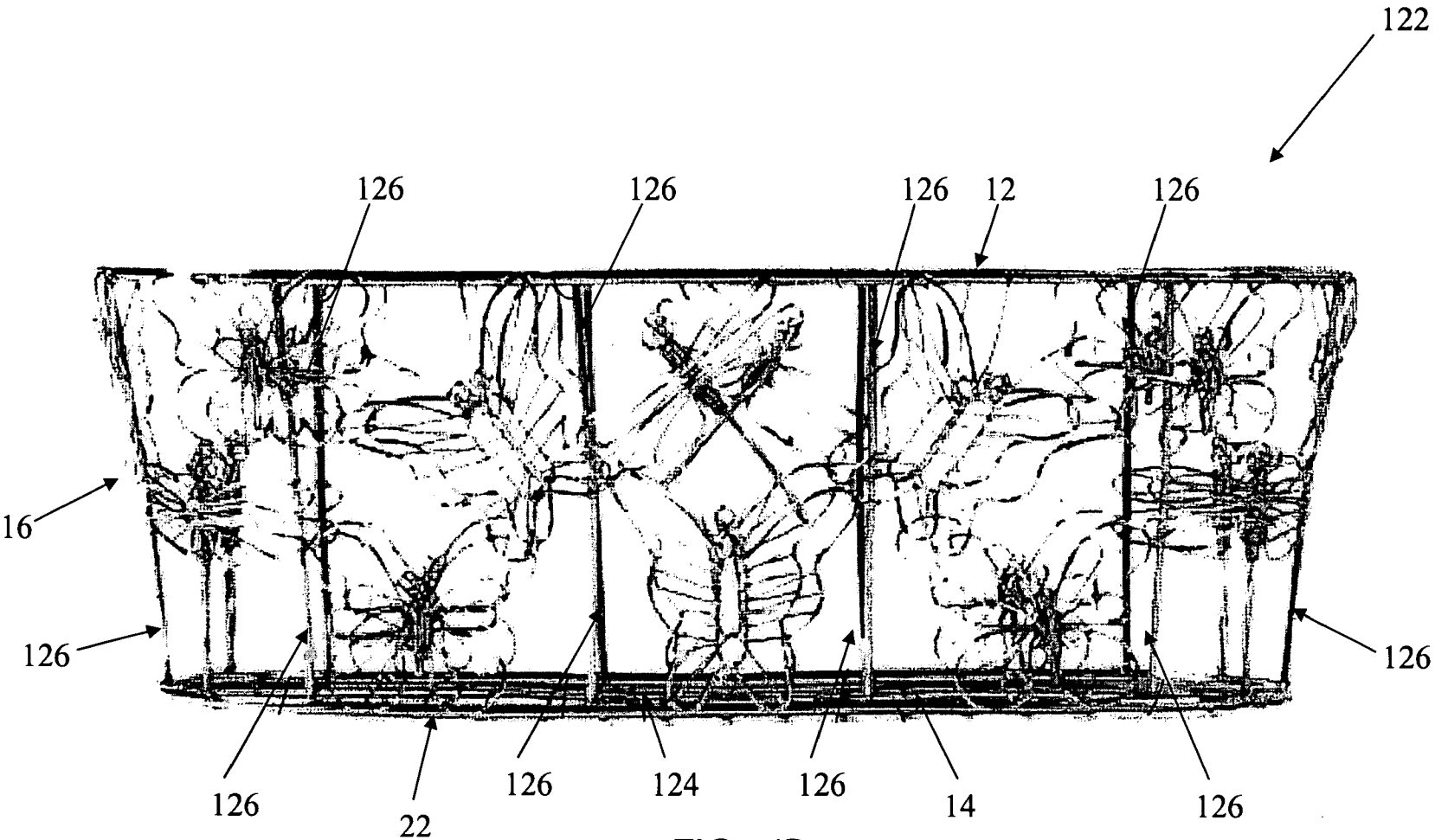
FIG. 4B is a front view of the pannier of FIG. 4A.

Fruit bowl 128 (FIGS. 5A–C) is significant for at least two reasons: (1) it should dispel any impression that may have developed due to the previous embodiments that upper and lower support wires 12 and 14 must be approximately equal in size and shape to ensure strong vertical sidewalls, especially when sidewalls 16 consist solely of decorative items 18; and (2) it shows that combinations of decorative items arranged according to the triangle principle are strong enough to form a large container with arcuately curved sidewalls without additional vertical support wires, such as wires 90 and 126 (FIGS. 3A and 4A).

Figure 5B:
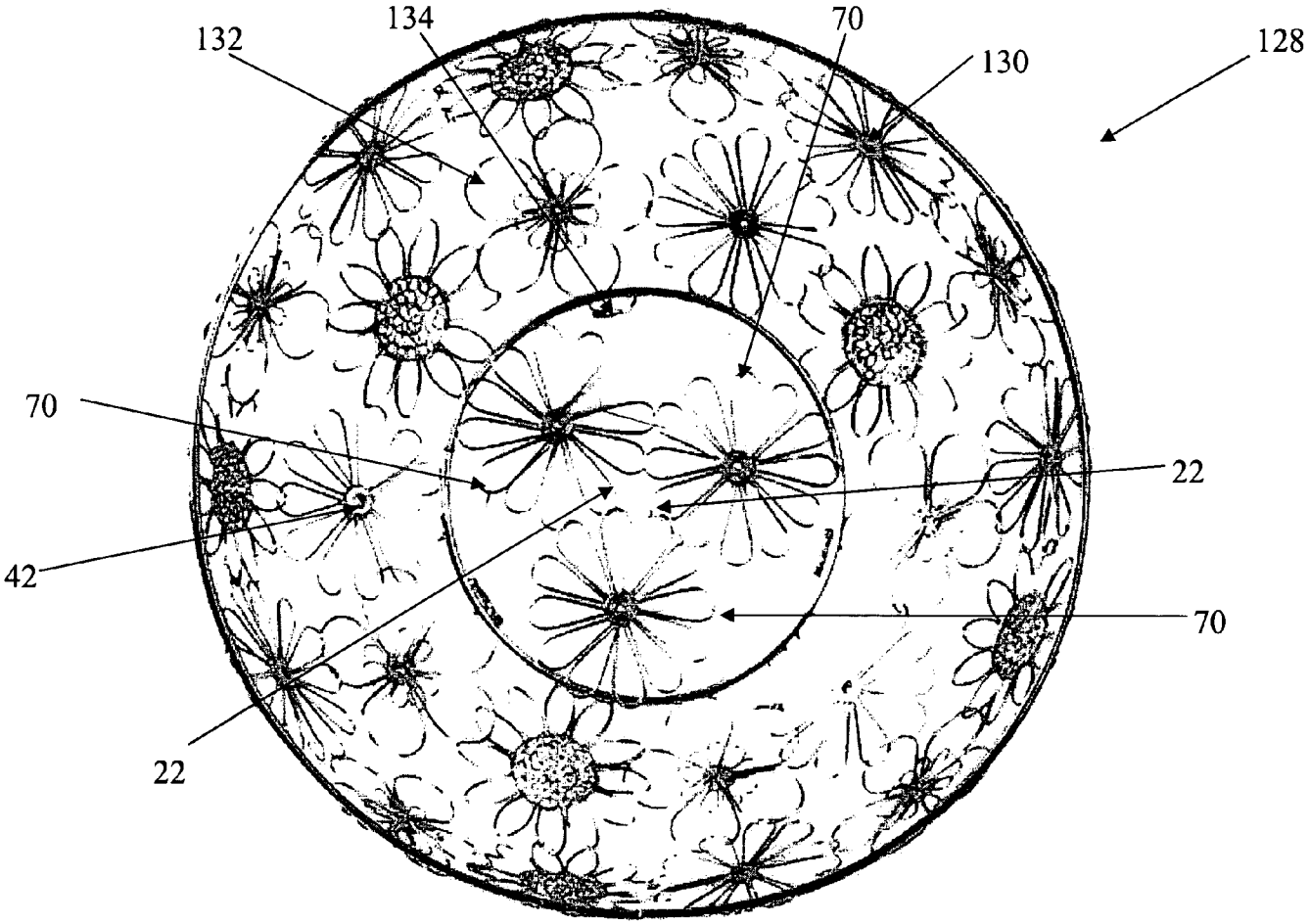
FIG. 5B is a top view of the bowl of FIG. 5A.
Figure 5C:
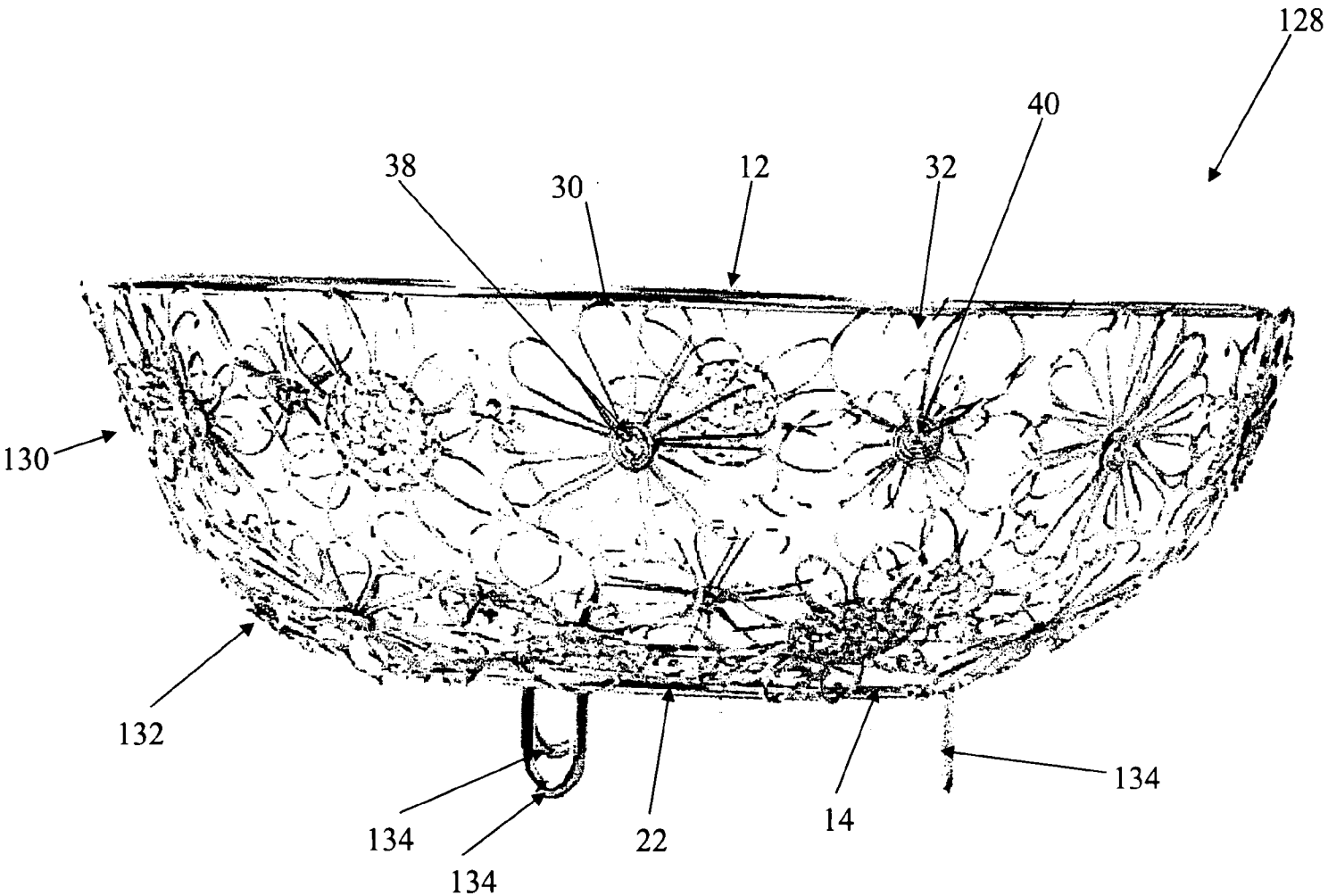
FIG. 5C is a side view of the of bowl of FIG. 5A.

Top 24 bordered by upper support wire 12 is of a much larger diameter than bottom 22 surrounded by lower support wire 14 (FIG. 5C). The resulting bowl will necessarily have either an arcuate sidewall 16 as shown most clearly in the side view of FIG. 5C, or a linear, i.e., conical, sidewall (not shown). In order to achieve this stability, each flower 26 of an upper, annular row 130 of flowers are attached to upper support wire 12 and to each of its neighbors within row 130; see the back sidewall of FIG. 5A. Each flower of a lower, annular row 132 of flowers is attached to lower support wire 14 and to each of its neighboring flowers 26 within row 132 (FIG. 5B). Most of the flowers 26 in upper row 130 are connected to flowers 26 in lower row 132 (FIG. 5B). The result is a sidewall 16 of remarkable rigidity, unexpected in view of the delicate appearance of flowers 26. A close examination of FIGS. 5A–C reveals the many uses of triangular connections, each of which strengthens the others. The three daisies 70 closing bottom 22 (FIG. 5B) exhibits the triangle principle in its purest form.

To complete the description of this embodiment, three U-shaped legs 134 are fixedly attached to lower wire 14 to support fruit bowl 128.

It is clear from the above that the objects of the invention have been fulfilled. It is equally clear that other containers can be designed using the principles of the invention, including, but not limited to note paper holders, office organizer trays, pencil cups, letter trays and holders, waste cans, and various kinds of candleholders and baskets.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U. S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A wire container, comprising:

a lower support wire forming a base;

an upper support wire forming a top;

a plurality of wire figures, each of said wire figures having a wire forming a central body and a plurality of loops outwardly extending from the central body and circumferentially offset from one another, said central body and said plurality of loops formed to simulate a flower; and a sidewall coupling said base to said top so as to create a chamber in said container, said sidewall comprising said plurality of said wire figures.

2. The wire container as set forth in claim 1, wherein said plurality of said wire figures are similar to each other.

3. The wire container as set forth in claim 1, wherein at least two of said wire figures are different from one another.

4. The wire container as set forth in claim 1, wherein each said wire figures comprise a first piece of wire forming said central body and a separately formed second piece of wire forming said plurality of loops.

5. The wire container of claim 1, further including a bottom formed according to one configuration selected from the following group: a helical wire, a solid plate, open wire mesh, and at least one of additional wire figure.

6. The wire container of claim 1, wherein the shape of said central body is selected from one of the following: circular, helical, coiled, linear, and oval.

7. The wire container of claim 1, wherein said wire container is configured to be selected one of the following: storage cup, tea light cup, voltive cup, candle holder pencil cup, note paper holder, letter tray, letter holder, waste can, pannier, basket, fruit bowl, napkin holder, and office organization tray.

8. The container of claim 1, wherein each of said wire figures has selected portions fixedly attached to selected portions of said lower support wire and said upper support wire.

9. The container of claim 1, wherein at least some of said wire figures have selected portions fixedly attached to selected portions of said lower support wire and another of said wire figures.

10. The container of claim 1, wherein at least some of said wire figures have selected portions fixedly attached to selected portions of said upper support wire and another of said wire figures.

11. The container of claims 8, wherein said selected portions form a triangular brace.

12. The container of claims 9, wherein said selected portions form a triangular brace.

13. The container of claims 10, wherein said selected portions form a triangular brace.

14. The container of claim 1, wherein said lower and upper support wires have a first thickness and said wire forming said wire figures have a second thickness different from said first thickness.

15. The container of claim 14, wherein features of said wire figures which are known to be more delicate than other features thereof are formed of the thinnest wires of said wire container.

16. The container of claim 1, further comprising a plurality of vertical support wires, wherein said upper and lower support wires and each of said plurality of vertical support wires have substantially the same thickness, and each of said plurality of vertical support wires have opposite ends fixedly attached, respectively, to said lower support wire and said upper support wire and forming therewith a support framework for said container.

17. The container of claim 16, wherein each of said wire figures have selected portions fixedly attached to selected portions of at least three from the following group: (1) at least one other of said wire figures; (2) said upper support wire; (3) at least one of said vertical support wires; and (4) said lower support wire.

* * * * *